United States Patent [19]

Bauch et al.

[11] Patent Number: 4,979,680

[45] Date of Patent: Dec. 25, 1990

[54] SPRAY GUN

[75] Inventors: Helmut Bauch; Wolfgang Kleber, both of Dresden, German Democratic Rep.

[73] Assignee: VEB Infrarot-Anlagen Oranienburg, Oranienbrug, German Democratic Rep.

[21] Appl. No.: 263,274

[22] Filed: Oct. 27, 1988

[30] Foreign Application Priority Data

Oct. 27, 1987 [DD] German Democratic Rep. ... 308300

[51] Int. Cl.[5] ..... B05B 5/02

[52] U.S. Cl. ..... 239/692; 239/704; 239/706; 239/708

[58] Field of Search ..... 239/690, 690.1, 704, 239/706, 708, 697, 707, 692, 705, 3

[56] References Cited

U.S. PATENT DOCUMENTS

| | | | |
|---|---|---|---|
| 4,090,666 | 5/1978 | Peck | 239/692 |
| 4,135,667 | 1/1979 | Benedek et al. | 239/697 |
| 4,498,631 | 2/1985 | Gourdine | 239/704 |
| 4,659,019 | 4/1987 | Talacko | 239/692 |
| 4,735,360 | 4/1988 | Kirchner et al. | 239/705 |
| 4,798,338 | 1/1989 | Bauch et al. | 239/708 |

FOREIGN PATENT DOCUMENTS

| | | | |
|---|---|---|---|
| 106308 | 10/1976 | Fed. Rep. of Germany . | |
| 134841 | 3/1979 | Fed. Rep. of Germany . | |
| 181198 | 7/1984 | Hungary . | |
| 0761016 | 9/1980 | U.S.S.R. | 239/708 |
| 0927327 | 5/1982 | U.S.S.R. | 239/706 |
| 2118865 | 11/1983 | United Kingdom . | |

*Primary Examiner*—Andres Kashnikow
*Assistant Examiner*—Christopher G. Trainor
*Attorney, Agent, or Firm*—Schweitzer Cornman & Gross

[57] ABSTRACT

A spray gun with electrokinetic charging of powdered material for the purpose of electrostatically coating workpieces with a powder coating. As the powder flows pneumatically through a channel of insulation material in the form of an annular gap, the plastic powder to be applied is charged by superimposition of triboelectric effects with ionization processes initiated by these effects at a passive ionizer electrode, and completed by friction against a semiconductive insert within the annular gap. Thus, the effective area of the electrostatic induction ionizer is expanded, the charge on the powder is increased and spark-like sliding discharges in the flow channels as well as dielectric breakdowns of the channel wall are prevented.

9 Claims, 3 Drawing Sheets

SPRAY GUN

FIELD OF THE INVENTION

The present invention relates to a spray gun with electrokinetic charging of powdered material for the purpose of the electrostatic surface coating of objects with a powder coating. It can be used as a manually as well as automatically guided spraying device, as well as a charging organ in fluidized bed or tunnel installations. As coating materials, thermoreactive or thermoplastic synthetic materials, enamel or similar materials can be used in powder form.

BACKGROUND OF THE INVENTION

Spraying equipment for the electrostatic coating of surfaces is known. With this equipment, the powdered coating material, flowing pneumatically through a special channel comprising an insulator which tends to develop triboelectric charges, is charged electrically through friction effects and atomized to a highly dispersed powder cloud in the outlet opening of the channel by flow guiding elements (baffles) or radial air jets (West German (FRG) patents Nos. 1,577,757, 2,203,351 and 2,257,316).

It is a disadvantage of the known apparatus that only such powder can be used which tends to develop a very high triboelectric charge. Moreover, it operates with a relatively low powder concentration in the carrier gas, to achieve a powder charge, which is adequate for the process, by frequent contact of the powder particles with the interior wall of the flow channel.

Various measures have been proposed to increase the electrical charge on the powder particles, which are directed toward intensifying the turbulence of the flow and thus the intensity and frequency of wall contacts by the powder particles, such as the use of surface profiling in the channel wall (FRG patent No. 2,209,231), the design of the flow channel in the shape of a longer, curved charging tube of small cross sectional area (FRG patent No. 3,100,002) and the use of a friction cone (German Democratic Republic (GDR) patent No. 134,841) or a flow guide element with spiral grooves or channels (FRG utility patent No. 8,516,746) in the insulating material channel (GDR patent No. 134,841) or of special turbulence-producing equipment in the form of vanes (FRG patent No. 2,938,606), propellers (U.S. Pat. No. 3,905,330) or a fan wheel (FRG patent No. 2,451,514). Moreover, structural embodiments of the triboelectric charging channel are known, for which a reduced pressure is produced in the powder inlet section or in the outlet opening by increasing the flow velocity at the curved surfaces of insulating material by means of addition air jets. This reduced pressure leads the powder particles to the surface of insulating material (FRG patent No. 2,713,697) or, by generating a helical particle path (FRG patent No. 2,756,009), causes a more intensive contact with the wall.

Moreover, solutions for electrostatic spray equipment are known, for which the powder, by superimposing triboelectric effects, is charged by ionization processes initiated by these effects (GDR patents Nos. 106,308 and 232,595). In the inlet zone of the triboelectric charging channel, this spraying equipment contains a grounded electrode, which functions as a passive electrostatic induction ionizer. The powder particles, dispersed in carrier gas, first of all receive a charge due to triboelectric effects on contacting the wall surfaces of the channel of insulating material. While the charge on the powder particles is continuously transported out of the channel of insulating material with the flow, a charge of equal magnitude and opposite polarity remains on the wall of this channel. This charge grows constantly and induces a charge of the same polarity as the powder charge, until the field, developing between the two charges, exceeds the electrical strength of the carrier gas and gas ionization commences before the electrode. The gas ions, moving towards the wall of the channel of insulating material, have the same polarity as the powder charge produced triboelectrically. They lead to a compensation of the surface charge on the wall of the channel of insulating material and thus regenerate the surface for a further triboelectric charge. At the same time, a portion of the ions is deposited on the powder particles flowing by. The charge on the particles, produced triboelectrically, is thus increased. Alternatively, the neutral powder particles, which flow through the channel without contacting the wall, are also charged electrically.

It is a disadvantage of these solutions that the ionization processes take place in a narrow flow channel, which generally is constructed as a narrow annular gap. The surfaces of insulating material of this gap have a shielding effect with respect to the axial electrical field, so that the effective area of the ionizer electrode is limited to the initial section of the channel of insulating material. The high surface charge densities, accumulating in remote regions, can lead to interfering, spark-like sliding discharges along the interior surface of the channel of insulating material or even to dielectric breakdowns of the channel wall.

DESCRIPTION OF THE INVENTION

It is an object of the invention to improve the operational capabilities of spray guns with electrokinetic powder charging by higher and more stable powder charges and by suppressing spark-like sliding discharges in the insulating material channel as well as by preventing electrical breakdowns.

It is a further object of the invention to eliminate the described deficiencies of the known technical solutions by increasing the effective area of the electrostatic induction generator.

Pursuant to the invention, this objective is accomplished by equipping the insulating material channel with a central flow guiding element, which has one or several sections of an electrical semiconducting material or have a surface layer of such a material and which are electrically insulated from one another as well as from the ionizer electrode. The other sections comprise an insulating material, which tends to develop triboelectric charges.

In an advantageous embodiment of the invention, the flow guiding element is constructed as a cylindrical rod with a conical tip, with the proviso that a cylindrical section of the rod, lying at the start with respect to the direction of the flow, consists to the extent of more than 25 to 75% of the length of the rod of an electrical semiconductor, or has a surface of such a material, while the remaining parts of the flow element are of the same insulating material as the hollow rod, this latter material tending to develop triboelectric charges.

In a further advantageous form of realizing the invention, the cylindrical flow guiding element is composed of several sections in such a manner, that sections of electrically semiconducting material alternate with sections of an insulating material that tends to develop triboelectric charges.

In a further modified embodiment of the invention, the flow guiding element is composed of sections with a cylindrical shell and sections with a conical shell in such a manner, that a flow channel results with an essentially constant cross section and with a sectionally changing flow direction, with the proviso that individual sections of the flow guiding element, preferably those with a surface averted from the flow, are of an electrically semiconducting material or have a surface layer of such a material.

In a further advantageous development of the invention, a tubular sheath is disposed coaxially at one part of the channel length between the central rod and the inner wall of the insulating material channel, so that an annular gap results. The inner rod and/or the tubular sheath comprise an electrically semiconducting material.

In an appropriate embodiment of the invention, the electrically semiconducting sections of the flow guiding elements comprise a material with an electrical conductivity between $10^{-9}$ and $10^{-6}$ s/m, preferably a material, which tends to develop a triboelectric charge, with embedded conductive particles, especially with polytetrafluoroethylene containing 3 to 12% graphite. The semiconducting sections can also be produced from an insulating material with a semiconducting surface, the specific surface resistance $R_o$ of which, measured with two 10 cm long cutting electrodes 1 cm apart according to the GDR Standard TGL 15347, is $10^8$ to $10^{10}$ ohm.

DESCRIPTION OF THE DRAWING

The invention is described below in greater detail with reference being had to the cross-sectional views of the drawing wherein.

DESCRIPTION OF PREFERRED EMBODIMENTS

Figure 1:
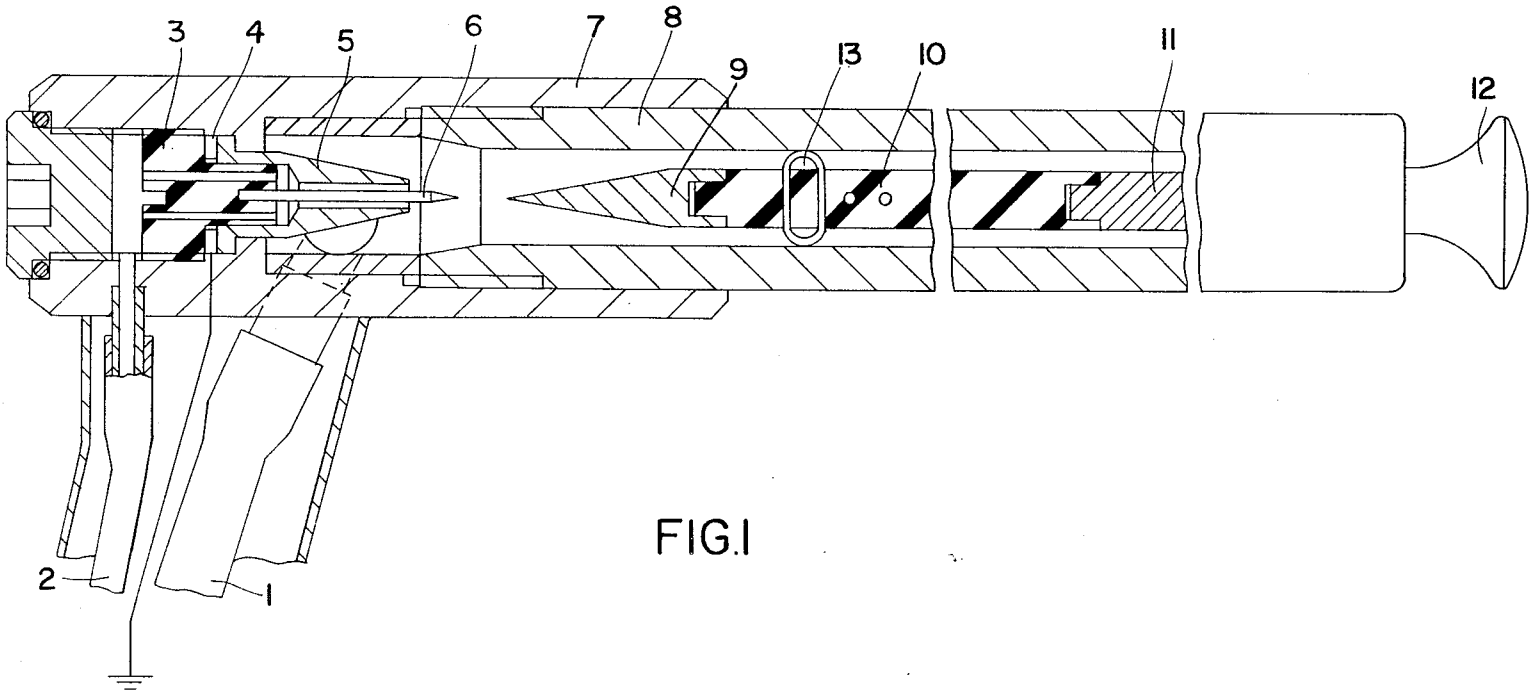
FIG. 1 shows a spray gun with an electrically semiconducting section of the cylindrical flow guiding element.

The principle of the inventive solution is disclosed very clearly in FIG. 1. The powder, is dispersed in a stream of carrier gas and is fed through a feeding channel 1, which discharges tangentially into a channel of insulating material. A second feeding channel 2 is supplied with a compressed gas, usually air, which is blown in through boreholes in an electrode holder 3 and in the annular gap-shaped channel 3*a* between a needle-shaped electrostatic induction electrode 6 and a sheath 5 of insulating material into the flow channel that follows. The gas washes all around the electrostatic induction electrode 6 and thus prevents powder sintering onto the electrode. The electrostatic induction electrode 6 is connected to earth potential by way of the contact ring 4. The feeding channel paths 1 and 2 of the powder and the gas are joined in the section of the spray gun following forward of the induction electrode 6. This is the inlet zone to the triboelectric charging portion. Here is also the entrance to the flow channel in which the electrokinetic charging of the powder takes place. The base structure 7 may be manufactured either from an insulating material or from a conducting material.

The annular gap-shaped flow channel that follows in the direction of flow, serves for electrically charging the powder. In a hollow rod 8 of insulating material, which tends to develop a triboelectric charge, a cylindrical flow guiding element consisting of rod sections 10 and 11 and having a conical tip 9 is inserted to divide the flow. Pursuant to the invention, the rod section 10, adjoining the tip, has a length of 25 to 75% of the length of the flow channel and comprises an electrically semiconducting material, while the subsequent section 11 of the rod made from the same insulating material as the hollow rod 8. Two spaces 13, which are mutually offset by 90°, serve to maintain movable rod in a concentric position within the hollow rod 8.

Due to the use of an electrically semiconducting material for the front rod section 10, the effective area of the electrostatic induction electrode 6 is significantly extended. Due to spray discharges from the surface of the rod to the surface charges on the opposite inner wall of the hollow rod 8 and on the subsequent channel sections, advantageous conditions for further triboelectric charging are created by neutralization of these charges. At the same time, the semiconducting rod section is charged to a high potential and a polarity opposite to that of the powder charge, consequently a stable corona discharge is developed from the electrostatic induction electrode 6 to this rod section, so that the powder particles passing through this zone, are additionally charged by absorption of gas ions. At the same time, the corona discharge limits the potential of the semiconducting rod section. The use of a semiconducting rod section, moreover, has the advantage that the surface charge density on the inner wall of the hollow rod is limited to a low value, so that spark-like discharges and electrical breakdowns of the channel wall cannot develop in the insulating material channel.

The semiconducting rod section can be divided, according to a further variation of the embodiment, into several parts (not shown), which are insulated from one another by separators of an insulating material.

Figure 2:
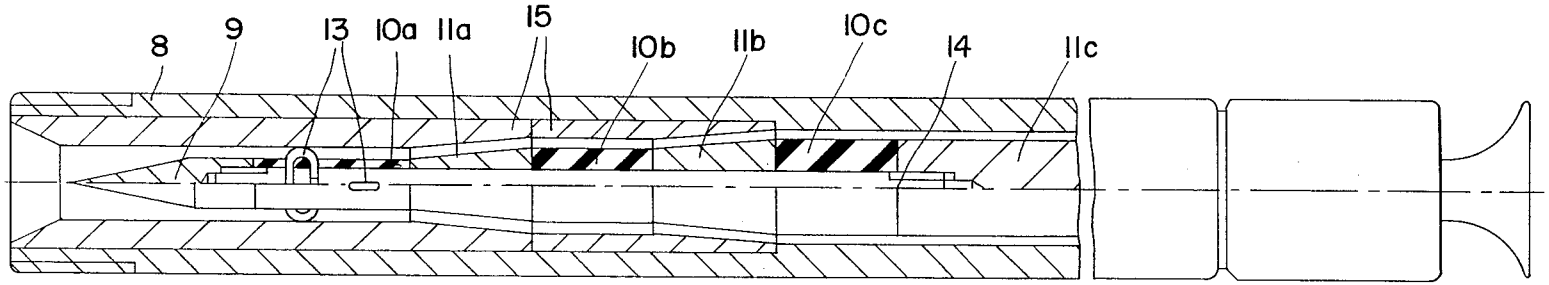
FIG. 2 shows a channel of insulating material with a constant flow cross section and a flow guiding element of expanding diameter and containing several semiconducting rod sections.

In an advantageous embodiment of the invention shown in FIG. 2, the concentric flow guiding element is composed by means of a centering rod 14 of alternating cylindrical and truncated cone sections. In each of the truncated cone sections 11*a* and 11*b*, the diameter of the flow guiding element increases. The interior surface of the hollow rod 8 is fitted with sleeve-like inserts of the same insulating material to the shape of the rod, so that the annular cross sectional area of the flow channel remains constant. The cylindrical intermediate sections 10*a*, 10*b* and 10*c* are of an electrically semiconducting material. Their surfaces are in each case disposed on the side averted from the flow, so that depositions of powder is suppressed.

Figure 3:
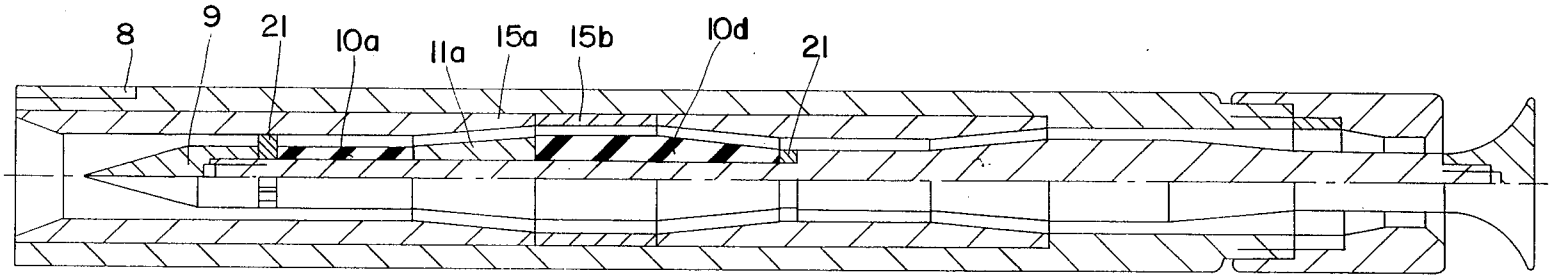
FIG. 3 shows the hollow rod and the flow guiding element with sections, which have a conical shell.

In a further embodiment of the invention, which is shown in FIG. 3, rod sections with cylindrical and conical shells are so disposed consecutively and the inner surfaces of the enveloping hollow rod are so fitted by appropriate inserts 15*a* and 15*b*, that an annular flow channel is formed, which has a constant cross section and a periodically changing average diameter. This results in repeated changes in the direction of flow and, through more intensive wall friction, leads to a higher triboelectric charge. The rod sections 10*a* and 10*d*, with a surface averted from the direction of flow, are made from an electrically semiconducting material or have a surface of such a material. They are disposed with intensive wall contact in the immediate vicinity of the surfaces of insulating material and facilitate charge neutralization there.

Figure 4:
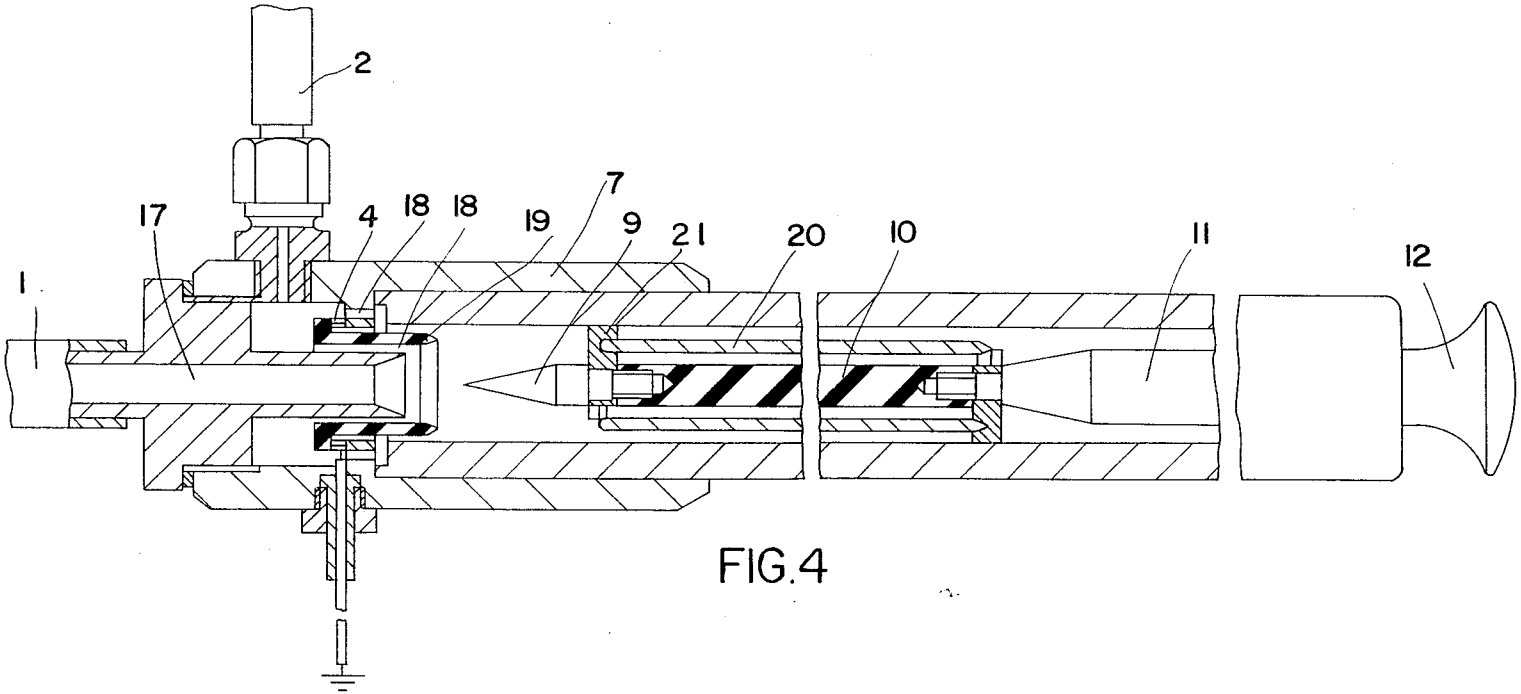
FIG. 4 shows a spray gun with a flow channel in the form of a double annular gap.

A different, appropriate embodiment example of the invention is shown in FIG. 4. The powder is supplied over the axial channel 1, 16 and flows through the electrostatic induction ionizer electrode 17, which has a sharp leading edge and an annular construction and is also flushed with gas through channels 18 to avoid encrustations by adhering powder. The compressed gas is supplied to feed channel 2. Through the use of a tubular sleeve 20 between the hollow rod 8 and the inner rod 10, a portion of the length of the channel of insulating material is constructed as a double annular gap, through which the powder flows.

Pursuant to the invention, the concentric sleeve 20 so and/or the central rod 10 along the length of this section is made partially or completely from a semiconducting material. The rod 10 and the sleeve 20 are held in their position by a star-shaped centering element 21. Over the whole length of the flow channel, that is, in the section of the double gap and in the subsequent single gap, the flow cross section is kept essentially constant. By increasing the surface area relative to the cross section, the triboelectric effects are greatly intensified without increasing the flow resistance.

A material, which has an electrical conductivity of $10^{-9}$ to $10^{-6}$ s/m and preferably of $10^{-8}$ to $10^{-7}$ was found to be particularly advantageous for the electrically semiconducting sections of the flow guiding element. In this region, the conductivity of the rod sections is admittedly high enough so that gas ionization, can develope uniformly distributed over the surface, can develop without being sufficient for the formation of spark discharges to other rod sections or grounded conductive parts of the spray gun or to the workpiece. The same effect is achieved through the use of an insulating material with a semiconducting surface layer, the specific surface resistance $R_o$ of which is $10^8$ to 10 ohm and preferably (0.5 . . . 5) $10^9$ ohm, measured with two 10 cm long cutting electrodes, 1 cm apart, according to the GDR Standard TGL 153347.

Polytetrafluoroethylene (PTFE) with 3 to 12% graphite, which tends to develop triboelectric charges, has proven to be a very advantageous material for the semiconducting rod sections.

We claim:

1. In a gun for the elektrokinetic charging and spraying electrically charged powder, having means for introducing powder into the gun, means for introducing a carrier gas into the gun, passive ionizer means, and a passage in which triboelectric charging of the powder takes place, said passage being in the form of an elongated, annular gap between an outer elongated, hollow element of an electrically insulating material and an inner, elongated flow guiding element disposed within said outer element, the improvement which comprises that at least a part of the body of said inner, elongated flow element that contacts said powder is constructed of a semiconductive material comprised of a plurality of sections, said material being effective to ionize the gas within said passage by forming a corona discharge to other parts of the gun, and wherein said semiconductive sections are not in electrically conductive or semiconductive relationship to said passive ionizer means or to one another, and the combined length of said semiconductive sections is from about 25% to about 75% of the length of said passage.

2. The gun of claim 1, wherein the inner, elongated flow guiding element has a conical end facing said passive ionizer means.

3. The gun of claim 1, wherein said outer and inner flow guiding elements have a cylindrical cross-section, and wherein said annular gap has a substantially constant width throughout its length.

4. The gun of claim 3, wherein the cross section of said inner and said outer flow guiding elements is varied throughout the length of said annular gap, whereby the diameter of said gap varies throughout its length.

5. The gun of claim 4, wherein said varying of the diameter includes alternatingly greater and lesser diameters, and wherein said semiconductive sections of semiconductor or of semiconductive surface are disposed in locations of decreasing diameter of said annular gap.

6. The gun of claim 1, wherein said inner flow guiding element is a first flow guiding element, and said gun comprises a second, elongated inner flow guiding element having surfaces of an effective semiconductive material, and being disposed substantially concentrically outside of said first inner flow guiding element, whereby two annular, elongated, substantially concentric gaps are formed within said outer flow guiding element.

7. The gun of claim 1, wherein the semiconductive sections have an electrical conductivity of from about $10^{-9}$ to about $10^{-6}$ s/m, or respectively the semiconductive surface has a resistance of from about $10^7$ to about $10^{10}$ ohm.

8. The gun of claim 1, wherein said inner elongated flow element is an electrical insulator and said semiconductive sections consist of electrically conductive particles embedded therein.

9. The gun of claim 8, wherein said electrical insulator is a PTFE resin, and said electrically conductive particles comprise from about 3 to about 12% (wt) graphite based.

* * * * *